United States Patent [19]

Meichsner et al.

[11] Patent Number: 4,764,211

[45] Date of Patent: Aug. 16, 1988

[54] FINE-GRAINED AGENT FOR DESULFURIZING MOLTEN IRON

[75] Inventors: Walter Meichsner, Krefeld; Werner Gmohling, Hufschlag; Manfred Tutte, Moers; Karl-Heinz Peters, Dinslaken, all of Fed. Rep. of Germany

[73] Assignees: Thyssen Stahl AG, Duisburg; SKW Trostberg AG, Trostberg, both of Fed. Rep. of Germany

[21] Appl. No.: 942,469

[22] Filed: Dec. 16, 1986

[30] Foreign Application Priority Data

Dec. 17, 1985 [DE] Fed. Rep. of Germany ..... 3544563
Dec. 17, 1985 [DE] Fed. Rep. of Germany ..... 3544562

[51] Int. Cl.[4] ..... C21C 7/02
[52] U.S. Cl. ..... 75/58; 75/53
[58] Field of Search ..... 75/53, 58

[56] References Cited

U.S. PATENT DOCUMENTS 3,598,573 8/1971 Freissnnith et al. ..... 75/58
3,998,625 12/1976 Koros ..... 75/58
4,078,915 3/1978 Meichsner et al. ..... 75/58
4,159,906 7/1979 Meichsner et al. ..... 75/58
4,266,969 5/1981 Koros ..... 75/58
4,395,282 7/1983 Braun ..... 75/58
4,581,068 4/1986 Schramm ..... 75/58
4,592,777 6/1986 Rellermeyer et al. ..... 75/58

FOREIGN PATENT DOCUMENTS 1534586 12/1978 United Kingdom ..... 75/58

*Primary Examiner*—Peter D. Rosenberg
*Attorney, Agent, or Firm*—Sprung Horn Kramer & Woods

[57] ABSTRACT

A fine-grained agent for desulfurizing molten iron comprising industrial calcium carbide, dried coal which contains at least 15% by weight of volatile constituents and which, immediately after being passed into the molten iron, releases at least 80 standard liters of gas per kg of coal, and optionally contains fine-grained magnesium. The coals used are lignites, flame coal, gas-flame coal, gas coal or coking coal. The agent is prepared by addition of the dried coal to the calcium carbide, if appropriate, pre-crushed, and common comminuted to a grain size of 90% $<200$ $\mu$m. The fine-grained magnesium is present in the agent either in uniform distribution, or it is stored and fluidized separately from the carbide/coal mixture and added to the carbide/coal mixture in the transport line or in the lance, if appropriate, with variation during injection.

22 Claims, No Drawings

FINE-GRAINED AGENT FOR DESULFURIZING MOLTEN IRON

BACKGROUND OF THE INVENTION

1. Field of the Invention

The invention relates to agents, processes for the preparation of the agent, and use of the agent for desulfurization of iron melts outside a blast furnace. Iron melts here are taken to mean pig iron and cast iron melts.

2. Background Information

The desulfurization of pig iron, outside a blast furnace, in the torpedo or open ladle is now part of the state of the art. Mixtures based on calcium carbide have prevailed as the preferred desulfurization agent, since these cause rapid desulfurization of the pig iron, along with high economy, and lead to low final sulfur contents. A particularly preferred agent is represented by a mixture comprising 20 to 90% by weight of industrial calcium carbide and calcium carbonate, preferably in precipitated form, and 2 to 20% by weight of carbon distributed therein, the fine-grain calcium carbonate/-carbon mixture being known under the name "diamide lime" (German Pat. No. 1,758,250).

German Auslegeschrift No. 2,531,047 has disclosed a process for desulfurizing pig iron, wherein a mixture of calcium carbide, calcium cyanamide or lime containing a proportion of 0.5 to 3.5% by weight of aluminium or magnesium powder, relative to the calcium compounds, is used as the desulfurizing agent.

In U.S. Pat. No. 3,998,625, a desulfurizing agent consisting of a combination of lime and further constituents with magnesium is described, and the use of lime with a carbonaceous material and a non-oxidizing carrier gas is recommended in U.S. Pat. No. 4,266,969.

The disadvantage of the known agents are the large quantities of slag which are obtained and which lead to undesirable deposits and incrustations, particularly in the torpedo ladles and also in open ladles, and in addition enclose considerable quantities of iron, which causes considerable losses of iron.

It has also already been proposed that, in place of calcium carbonate, an additive be added to the calcium carbide which generates hydrogen at the temperature of iron melt (German Pat. No. 2,252,796). However, such a desulfurization agent has not proven itself in practice, since the generation of hydrogen obviously does not occur in such a fashion that an adequate dispersion of the calcium carbide in the iron melt could be effected.

It has been disclosed that calcium carbide can be employed, during the treatment of cast iron melts, as a desulfurization agent together with carbon, for example, in the form of pitch coke, animal charcoal or leather charcoal, but the types of coal proposed contain virtually no volatile components (see the state of the art indicated in German Pat. No. 1,758,250).

SUMMARY OF THE INVENTION

An object of the present invention is therefore to develop a desulfurization agent, based on calcium carbide, which, on the one hand, does not introduce further slag-forming components into the iron melt and, on the other hand, evolves an amount of gas, if possible, immediately after entry into the iron melt, which is adequate for the dispersion of the calcium carbide. Furthermore, advantageous consumption values, short treatment times and low final sulfur contents should be achieved using such desulfurization agent.

This object is achieved by a fine-grain agent, which is injected into the iron melt in fluidized form by means of a gas, which agent comprises a mixture of industrial calcium carbide and a dried coal which contains at least 15% by weight of volatile components and which immediately after being passed into the molten iron, releases at least 80 standard liters of gas per kg of coal.

DETAILED DESCRIPTION OF THE INVENTION

Industrial calcium carbide is taken to mean a product which contains 65 to 85% by weight of $CaC_2$ and the remainder of which mainly comprises lime. The proportion of industrial calcium carbide can vary within a wide range in the agent according to the invention. The proportion of coal also varies correspondingly. The mixture preferably contains 50 to 98% by weight of calcium carbide and 50 to 2% by weight of coal. Particularly preferred mixtures are those with contents of 80 to 96% by weight of industrial calcium carbide and 20 to 4% by weight of dried coal.

The mixture can contain additionally magnesium. Preferred are mixtures with contents of 47.5 to 95.5% by weight of industrial calcium carbide, 50 to 2% by weight of dried coal and 2 to 40% by weight of magnesium.

It has furthermore proven advantageous to choose those types of coal which, as dried product, release about 90% by weight of their volatile components within less than 60 seconds on pneumatic feeding into the iron melt, i.e., at a heating rate of $10^3$ to $10^6$° C./second. However, preferred coals are those which release about 90% of their volatile components within less than 40 seconds. Coals which are particularly preferable are those whose volatile components are released within 10 seconds at the temperature of the iron melt. The higher the proportion of volatile constituents in the coal, the higher is in general the effectiveness of the desulfurizing agent. Thus, coals are also used which contain at least 25% by weight of volatile constituents. Preferably, however, coals are used which, in the dried form immediately after being passed into the molten iron, evolve a gas volume of at least 150 standard liters/kg. Coals which meet these conditions are especially lignites, flame coal, gas-flame, gas coal and coking coal. They are tabulated below:

TABLE 1

| Coal Type | Volatile Components % | Amount of Gas Evolved (l/Kg) | Duration of Gas Evolution (seconds) |
|---|---|---|---|
| Soft Lignite | 50–60 | 450–550 | 7 |
| Hard Lignite | 45–50 | 375–450 | 8 |
| Flame Coal | 40–50 | 350–450 | 30 |
| Gas-Flame Coal | 35–40 | 275–350 | 30 |
| Gas Coal | 28–35 | 200–275 | 40 |
| Diamide Lime | 35–40 | 150–190 | 104 |

The volatile components specified in Table 1 above for the various types of coal were taken from *Rompps Chemie-Lexikon,* 8th Edition, 1983, Vol. 3, page 2142.

The amount of gas evolved in l/kg is that amount of gas which escapes on very rapid heating of the coal to the pig iron temperature.

The volatile components of the diamide lime are taken to mean the amount of $CO_2$ liberated during the carbonate decomposition.

The duration of gas evolution indicates the time (seconds) taken for about 90% of the total amount of gas to be evolved.

If it should prove expedient, two or more coal grades with high contents of volatile constituents can also be used as a mixture.

The moisture content of the dried coal should be less than 0.5% by weight, in order to prevent formation of acetylene by reaction with the calcium carbide. Such levels of drying are achieved in commercially available drying equipment, such as helical dryers, fluid-bed dryers or mill-dryers, and on drying in vacuo in simple equipment, wherein the material which is to be dried is merely moved or turned over.

The magnesium to be used has a grain size of less than 1 mm. Preferably, a magnesium is used which has already been grinded to <500 μm, and a magnesium having a grain size of <350 μm is particularly preferred.

It may be advantageous, to add to the mixture 1 to 10% by weight of fluorspar, e.g., to improve the properties of the slag which originates during the desulfurization. The mixture contains preferably 2 to 6% by weight of fluorspar. Fluorspar may be replaced by aluminum oxide as alumina or aluminum dross containing up to 30% metallic aluminum.

The constituents of the agent according to the invention except magnesium are grinded and mixed intensively, and they are grinded to such an extent that at least 90% by weight of the mixture has a grain size of <200 μm, and preferably 90% by weight has a grain size of <100 μm and 40 to 65% by weight has a grain size of <50 μm. Certain deviations from these figures are immaterial to the desulfurization effect.

For preparing the agent according to the invention, dried coal is added at controlled rates to the calcium carbide, which may have been pre-crushed or pre-ground, and the mixture as a whole is brought to the required grain fineness in a mill, e.g., a tube mill. It may then prove advantageous to operate under inert gas blanketing, in order to ensure that any small quantities of acetylene formed are immediately removed from the mixing and grinding unit.

The magnesium can be added under control to the agent consisting of calcium carbide and dried coal, so that the agent is pneumatically fed as a homogeneous mixture into the melt. Preferably, the content of technical calcium carbide is adjusted to 47.5 to 95.5% by weight, particularly preferably 66 to 86% by weight; that of dried coal is adjusted to 50 to 2% by weight, particularly preferably to 20 to 4% by weight; and that of fine-grained magnesium is adjusted to 2.5 to 40% by weight, particularly preferably 10 to 30% by weight. On the other hand, it has frequently proved to be advantageous to store the carbide/coal mixture, after it has been prepared, separately from the magnesium and to combine the two constituents after separate fluidization in the conveying line or in the lance and to introduce them together into the melt. This method of separately fluidizing and coinjecting the carbide/coal mixture and the magnesium has the advantage that the proportion of magnesium in the mixture can be varied during injection and coarser magnesium can be used.

Moreover, the process according to the invention comprises injecting the agent in a fluidized form by means of a carrier gas at a rate of 3 to 30 standard liters/kg of agent to a level as deep as possible into the molten iron. The feed rate of the gent should amount to 10 to 100 kg/minute; preferably, the feed rate used is 30 to 80 kg/minute of desulfurizing agent.

The carrier gases used for the desulfurizing agent are preferably nonoxidizing gases, such as argon or nitrogen alone or as a mixture, or dried air.

In conjunction with the process according to the invention, the desulfurizing agent according to the invention has considerable advantages over hitherto known agents. Thus, apart from the small quantity of ash contained therein, the coal virtually does not introduce any further slag-forming constituents into the molten iron. Thus, when the desulfurizing agent according to the invention is used, considerably less slag is obtained than in the case where calcium carbonate or calcium hydroxide are used as the gas-evolving additives.

In comparison with the known additives which evolve hydrogen and carbon dioxide, coal has the advantage that a sufficient quantity of gas is evolved immediately after the coal has been passed into the molten iron, and virtually complete dispersion of the fine-grained calcium carbide and of the magnesium in the molten iron is achieved. As a result, the desulfurizing effect of the agent proposed according to the invention is superior to the known desulfurizing mixtures based on calcium carbide.

In comparison with known desulfurization mixtures with at least 50% magnesium, the mixture according to the invention has the surprising advantage that the treatment of the iron melts can be shortened considerably; the degree of shortening is more than expected from the reactivity of magnesium and calcium carbide.

In conjunction with the injection process described, the desulfurizing agent according to the invention is equally suitable for pig iron desulfurization in the open ladle and in the torpedo ladle.

The especially low requirement of injection gas manifests itself as an advantage; the composition of the agent guarantees adequate distribution, so that a high degree of utilization of the desulfurizing agent is achieved.

The use of the agent according to the invention by means of the process of the invention allows a marked increase in the degree of desulfurization or requires a significantly reduced quantity of desulfurizng agent for achieving the same desulfurization effect.

The use of the desulfurizing agent according to the invention enables short treatment times of the iron melts, so that in addition only slight cooling of the melt takes place. The resulting quantities of slag are small, so that the iron losses on deslagging are insignicant.

The non-limiting examples which follow are intended to explain the invention in more detail.

Examples

Under numbers 1 und 2 of Table 2 the results are shown which were obtained with conventional desulfurizing agents based on calcium carbide and diamide lime in an open ladle; results obtained with a mixture of 50% Mg and 50% ($Al_2O_3$ and Al) are shown under number 10. The results obtained with agents according to the invention are shown under numbers 3 to 9 and 11 to 13.

Results obtained in torpedo ladles are shown in Table 3.

The agents according to the invention are shown to be markedly superior to the conventional agents.

The abbreviations used in Table 2 and 3 are defined as follows:

| | |
|---|---|
| kg DS agent / t PI | quantity of desulfurizing agent injected per t (ton) of pig iron |
| kg DS agent / min | feed rate of desulfurizing agent in kg per minute |
| $S_I$ | initial sulfur content of the molten pig iron |
| $S_E$ | end sulfur content of the molten pig iron after treatment |
| α-value | coefficient for the effectiveness of the desulfurizing agent (quotient of injected quantity of desulfurizing agent and difference between the initial and end sulfur contents of the molten pig iron × 100) |
| carbide | industrial calcium carbide |
| Mg | magnesium |
| CaD 8515 | agent consisting of 85% by weight of industrial carbide and 15% by weight of diamide lime |
| % | percent by weight |

TABLE 2

Desulfurization in the open ladle

| serial No. | desulfurizing agent | quantity of pig iron (t) | kg DS agent / t PI | kg DS agent / min | carrier gas | carrier gas rate, standard liters/kg | $S_I$ % | $S_E$ % | α | treatment time (min.) |
|---|---|---|---|---|---|---|---|---|---|---|
| 1 | CaD 8515 | 134 | 2.24 | 30 | dry compressed air | 8.5 | 0.027 | 0.015 | 1.87 | 10.0 |
| 2 | CaD 7525 | 195 | 2.70 | 75 | | 4.7 | 0.025 | 0.011 | 1.93 | 7.0 |
| 3[1] | 82% carbide + 5% lignite + 13% magnesium | 146 | 2.04 | 60 | $N_2$ | 6.5 | 0.034 | 0.008 | 0.78 | 5.0 |
| 4 | 85% carbide + 15% magnesium | 220 | 2.00 | 43 | $N_2$ | 6.0 | 0.018 | 0.008 | 2.0 | 10.3 |
| 5 | 85% carbide + 15% magnesium | 218 | 2.25 | 49 | $N_2$ | 6.0 | 0.017 | 0.004 | 1.73 | 10.1 |
| 6 | 85% carbide + 15% magnesium | 215 | 2.37 | 49 | $N_2$ | 6.0 | 0.019 | 0.004 | 1.58 | 10.5 |
| 7 | 80% carbide + 15% magnesium + 5% flame coal | 220 | 2.09 | 40 | $N_2$ | 6.0 | 0.018 | 0.002 | 1.31 | 11.6 |
| 8 | 80% carbide + 15% magnesium + 5% flame coal | 216 | 2.35 | 53 | $N_2$ | 6.0 | 0.019 | 0.002 | 1.38 | 9.5 |
| 9 | 80% carbide + 15% magnesium + 5% flame coal | 222 | 2.45 | 53 | $N_2$ | 6.0 | 0.020 | 0.002 | 1.36 | 10.3 |
| 10[2] | 50% magnesium + 50% ($Al_2O_3$ + Al) | 135 | 1.26 | 12 | Ar | 61.0 | 0.039 | 0.013 | 0.48 | 14.2 |
| 11[3] | 80% carbide + 15% magnesium + 5% $CaF_2$ | 136 | 2.09 | 52 | Ar | 14.0 | 0.038 | 0.021 | 1.23 | 5.5 |
| 12[4] | 76% carbide + 14% magnesium + 5% flame coal 5% $CaF_2$ | 138 | 2.13 | 53 | Ar | 13.8 | 0.035 | 0.013 | 0.97 | 5.5 |
| 13 | 95% carbide + 5% lignite | 135 | 1.95 | 40 | dry compressed air | 7.0 | 0.033 | 0.012 | 0.93 | 6.6 |

[1]Co-injection
[2]Mean value from 500 treatments
[3]Mean value from 12 experiments
[4]Mean value from 20 experiments

TABLE 3

Desulfurization in the torpedo ladle

| serial No. | desulfurizing agent | quantity of pig iron (t) | kg DS agent / t PI | kg DS agent / min | carrier gas | carrier gas rate, standard liters/kg | $S_I$ % | $S_E$ % | α | treatment time (min.) |
|---|---|---|---|---|---|---|---|---|---|---|
| 1 | CaD 6040 | 172 | 3.7 | 70 | dry compressed air | 7.5 | 0.035 | 0.012 | 1.61 | 9.1 |
| 2 | CaD 6040 | 165 | 4.2 | 70 | | 7.5 | 0.044 | 0.015 | 1.45 | 9.9 |
| 3 | 75% carbide + 15% flame coal + 10% magnesium | 180 | 2.15 | 55 | $N_2$ | 15.0 | 0.045 | 0.010 | 0.61 | 7.0 |
| 4 | 75% carbide + 10% lignite + 15% magnesium | 195 | 1.93 | 65 | $N_2$ | 10.0 | 0.046 | 0.013 | 0.58 | 5.8 |
| 5 | 70% carbide + 15% gas coal + 15% magnesium | 185 | 2.22 | 60 | $N_2$ | 12.0 | 0.043 | 0.011 | 0.69 | 6.8 |
| 6 | 85% carbide + 15% flame coal | 159 | 3.2 | 45 | $N_2$ | 12.5 | 0.048 | 0.012 | 0.89 | 11.3 |

It will be appreciated that the instant specification and claims are set forth by way of illustration and not limitation, and that various modifications and changes may be made without departing from the spirit and scope of the present invention.

What is claimed is:

1. A fine-grain agent for the desulfurization of molten iron, which is based on calcium carbide and which is injected in fluidized form into an iron melt by means of a gas, the agent consisting essentially of industrial calcium carbide and a dried coal which contains at least 15% by weight of volatile components and which evolves a gas volume of at least 80 standard liters of gas/kg of coal at the temperature of the iron melt.

2. An agent as claimed in claim 1, which contains 50 to 98% by weight of calcium carbide and 50 to 2% by weight of coal.

3. An agent as claimed in claim 2, which contains 80 to 96% by weight of calcium carbide and 20 to 4% by weight of coal.

4. An agent as claimed in claim 1, wherein the coal is dried coal and the moisture content of the dried coal is less than 0.5% by weight.

5. An agent as claimed in claim 1, wherein about 90% by weight of the volatile components are evolved within less than 60 seconds, at a heating rate of the coal of $10^3$ to $10^{6°}$ C./second, at the temperature of the iron melt.

6. An agent as claimed in claim 1, wherein about 90% by weight of the volatile components are evolved within less than 40 seconds, at a heating rate of the coal of $10^3$ to $10^{6°}$ C./second, at the temperature of the iron melt.

7. An agent as claimed in claim 1, wherein the volatile components of the coal are evolved within less than 10 seconds at the temperature of the iron melt.

8. An agent as claimed in claim 1, which further consisting essentially of magnesium.

9. An agent as claimed in claim 8, which contains 47.5 to 95.5% by weight of calcium carbide, 50 to 2% by weight of coal and 2.5 to 40% by weight of magnesium.

10. An agent as claimed in claim 9, wherein the industrial calcium carbide content is 66 to 86% by weight, the coal content, on a dry basis, is 20 to 4% by weight and the magnesium content is 10 to 30% by weight.

11. The agent as claimed in claim 1, wherein the coal, on a dry basis, contains at least 25% by weight of volatile components.

12. An agent as claimed in claim 1, wherein the coal evolves a gas volume of at least 150 standard liters/kg of coal.

13. An agent as claimed in claim 1, wherein the coal is a lignite.

14. An agent as claimed in claim 1, wherein the coal is selected from the group consisting of flame coal, gas-flame coal and gas coal.

15. An agent as claimed in claim 1, wherein at least 90% by weight of the agent has a grain size of $<200$ $\mu$m.

16. An agent as claimed in claim 1, wherein at least 90% by weight of the agent has a grain size of $<100$ $\mu$m and 40 to 60% by weight of the agent has a grain size of $<50$ $\mu$m.

17. An agent as claimed in claim 1, which further comprises 1 to 10% by weight of fluorspar.

18. An agent as claimed in claim 17, which comprises 2 to 6% by weight of fluorspar.

19. A process for the preparation of the agent as claimed in claim 1, comprising drying coal, adding pre-crushed calcium carbide and grinding the mixture to the desired degree of fineness in a mill.

20. A process for desulfurizing molten iron comprising injecting in fluidized form the agent as claimed in claim 1 with a carrier gas rate of 3 to 30 standard liters/kg of agent into an iron melt.

21. A process as claimed in claim 20, wherein the agent is injected into the iron melt with a feed rate of 10 to 100 kg/minute.

22. A process as claimed in claim 21, wherein at least one non-oxidizing gas selected from the group consisting of nitrogen and argon is used as the carrier gas.

* * * * *

UNITED STATES PATENT AND TRADEMARK OFFICE

CERTIFICATE OF CORRECTION

PATENT NO. : 4,764,211

DATED : August 16, 1988

INVENTOR(S) : Wlater Meichsner, et al

It is certified that error appears in the above-identified patent and that said Letters Patent is hereby corrected as shown below:

| | |
|---|---|
| Col. 4, line 3 | Delete "gent" and substitute --agent-- |
| Col. 4, line 54 | Correct spelling of --insignificant-- |
| Col. 5, line 12 | After "molten pig" insert --iron after treatment-- |

Signed and Sealed this

Ninth Day of May, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,764,211

DATED : August 16, 1988

INVENTOR(S) : Walter Meichsner et al

It is certified that error appears in the above-identified patent and that said Letters Patent is hereby corrected as shown below:

| | |
|---|---|
| Col. 4, line 3 | Delete "gent" and substitute --agent-- |
| Col. 4, line 54 | Correct spelling of --insignificant-- |
| Col. 5, line 12 | After "molten pig" insert --iron treatment-- |

This Certificate supersedes Certificate of Correction issued May 9, 1989.

Signed and Sealed this

Fourth Day of September, 1990

*Attest:*

HARRY F. MANBECK, JR.

*Attesting Officer*

*Commissioner of Patents and Trademarks*